US011428473B2

(12) United States Patent
Grotophorst

(10) Patent No.: US 11,428,473 B2
(45) Date of Patent: Aug. 30, 2022

(54) HEAT EXCHANGER

(71) Applicant: Modine Manufacturing Company, Racine, WI (US)

(72) Inventor: Thomas R. Grotophorst, Muskego, WI (US)

(73) Assignee: MODINE MANUFACTURING COMPANY, Racine, WI (US)

( * ) Notice: Subject to any disclaimer, the term of this patent is extended or adjusted under 35 U.S.C. 154(b) by 227 days.

(21) Appl. No.: 16/777,077

(22) Filed: Jan. 30, 2020

(65) Prior Publication Data

US 2020/0248966 A1 Aug. 6, 2020

Related U.S. Application Data

(60) Provisional application No. 62/800,189, filed on Feb. 1, 2019.

(51) Int. Cl.
*F28D 7/16* (2006.01)
*F28F 9/22* (2006.01)
(Continued)

(52) U.S. Cl.
CPC ..... *F28D 7/1646* (2013.01); *F28F 9/0219* (2013.01); *F28F 9/167* (2013.01);
(Continued)

(58) Field of Classification Search
CPC ..... F28F 9/0239; F28F 9/0219; F28F 9/165; F28D 7/1646
See application file for complete search history.

(56) References Cited

U.S. PATENT DOCUMENTS 8,794,299 B2 * 8/2014 Barfknecht ..... F28D 7/1692 165/41
9,097,466 B2 * 8/2015 Braic ..... F28F 9/0219
(Continued)

FOREIGN PATENT DOCUMENTS

CH 360844 A 3/1962
DE 907899 C 3/1954
(Continued)

OTHER PUBLICATIONS

Translation of WO2008125485A1 entitled Translation—WO2008125485A1 (Year: 2008).*
(Continued)

*Primary Examiner* — Paul Alvare
(74) *Attorney, Agent, or Firm* — Michael Best & Friedrich LLP

(57) ABSTRACT

A heat exchanger includes a housing with an inlet port, an outlet port, an interior facing surface defining a coolant channel, a first opening surrounded by an exterior facing surface, and a second opening defined by a first inner diameter. A tube assembly defines a plurality of exhaust gas flow channels and a plurality of coolant cross channels within the housing. A first diffuser directs a first fluid into the tube assembly and is joined to a first header plate, which separates the first fluid from a second fluid within the coolant channel. A second diffuser directs the first fluid out of the tube assembly. The second diffuser is located within the second opening and sealed to the second opening by seals around the second diffuser.

17 Claims, 7 Drawing Sheets

(51) Int. Cl.

| | |
|---|---|
| ***F28F 9/18*** | (2006.01) |
| ***F28F 9/02*** | (2006.01) |
| ***F28F 9/16*** | (2006.01) |
| *F28D 21/00* | (2006.01) |

(52) U.S. Cl.
CPC ..... *F28F 9/18* (2013.01); *F28F 9/22* (2013.01); *F28D 21/0003* (2013.01); *F28F 9/0239* (2013.01); *F28F 9/165* (2013.01); *F28F 2009/222* (2013.01); *F28F 2265/26* (2013.01)

(56) References Cited

U.S. PATENT DOCUMENTS

| | | | | |
|---|---|---|---|---|
| 9,279,395 | B2 | 3/2016 | Lorenz et al. | |
| 9,494,112 | B2 * | 11/2016 | Janke | F02M 26/28 |
| 9,512,807 | B2 * | 12/2016 | Grande Fernández | F02M 26/13 |
| 9,897,384 | B2 * | 2/2018 | Odillard | F28F 9/001 |
| 2009/0200003 | A1 * | 8/2009 | Digele | F01N 5/02 165/158 |
| 2015/0204623 | A1 * | 7/2015 | Neher | F28D 7/1684 165/81 |

FOREIGN PATENT DOCUMENTS

| | | | | |
|---|---|---|---|---|
| DE | 3212914 | A1 | 10/1983 | |
| DE | 102017220957 | A1 * | 5/2019 | F28F 9/007 |
| EP | 1903207 | A1 | 3/2008 | |
| JP | 05034084 | A * | 2/1993 | F28D 7/06 |
| WO | WO-2008125485 | A1 * | 10/2008 | F28F 9/0219 |

OTHER PUBLICATIONS

Translation of JP05034084A entitled Translation—JP05034084A (Year: 1993).*
Translation of DE102017220957A1 entitled DE102017220957A1 (Year: 2017).*

* cited by examiner

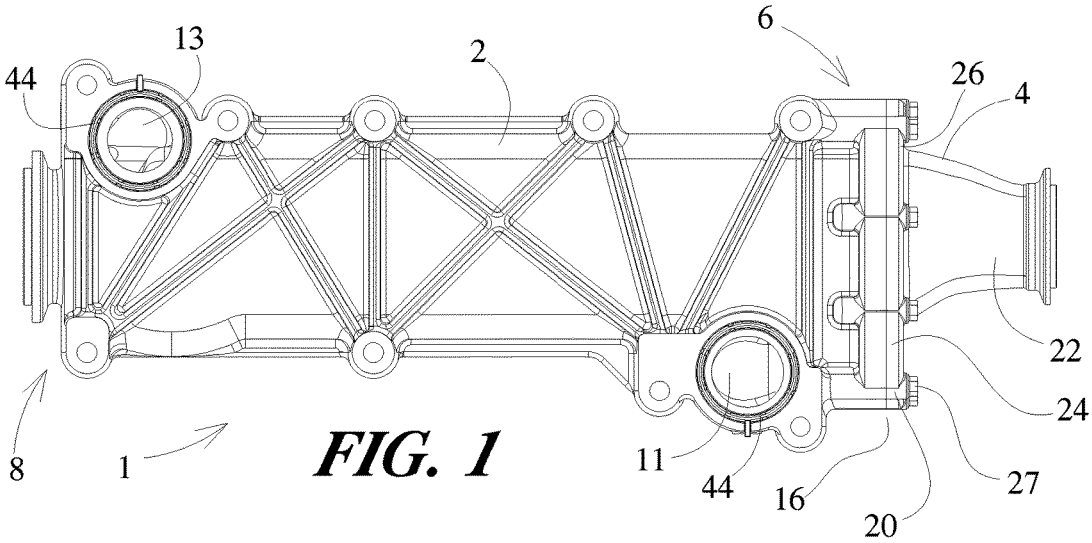
FIG. 1
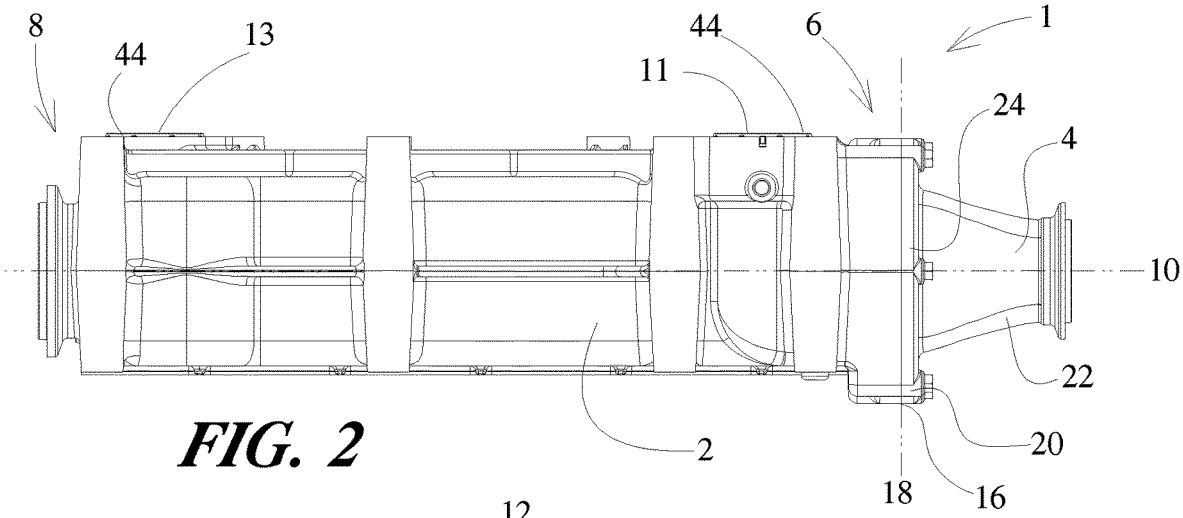
FIG. 2
FIG. 3
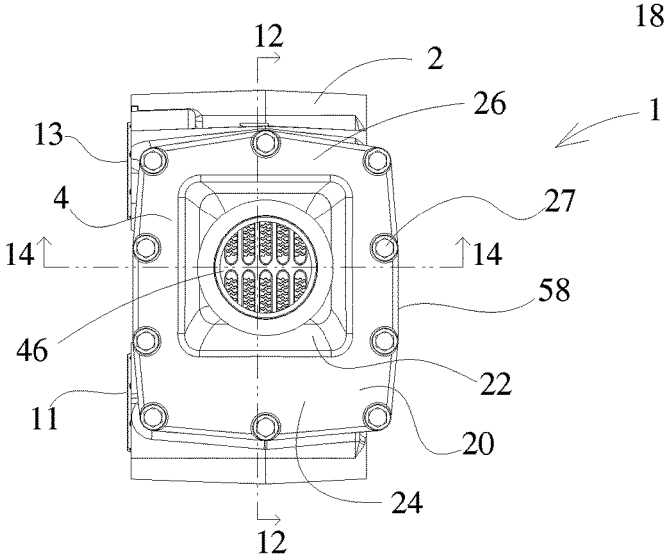

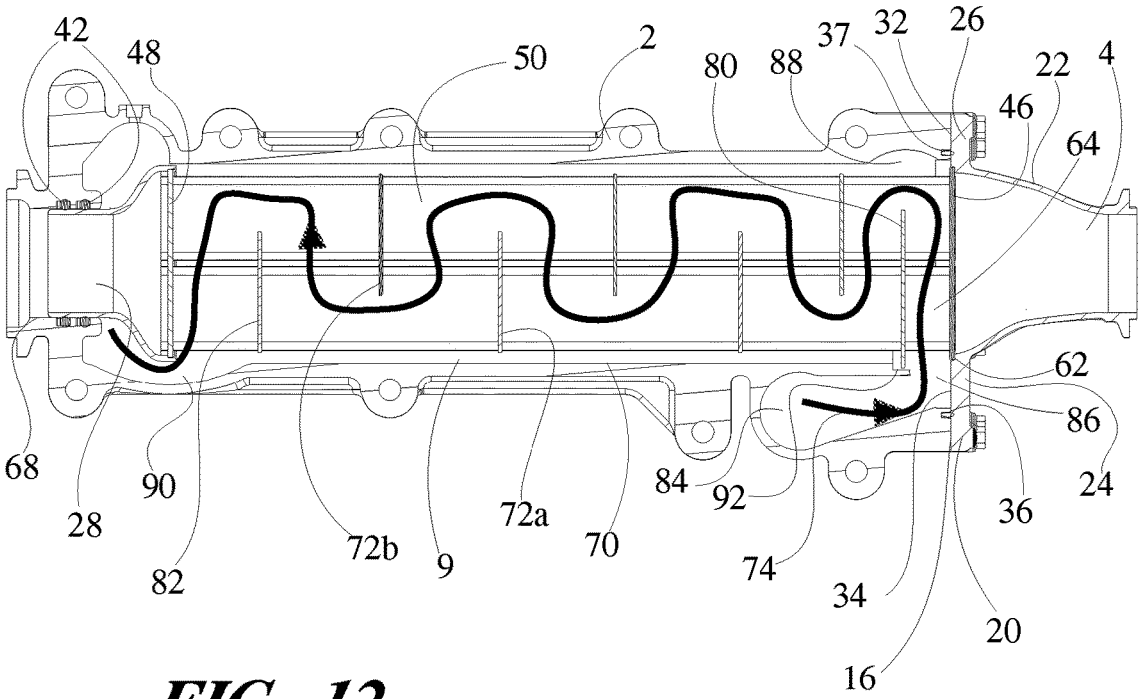
FIG. 12
FIG. 13
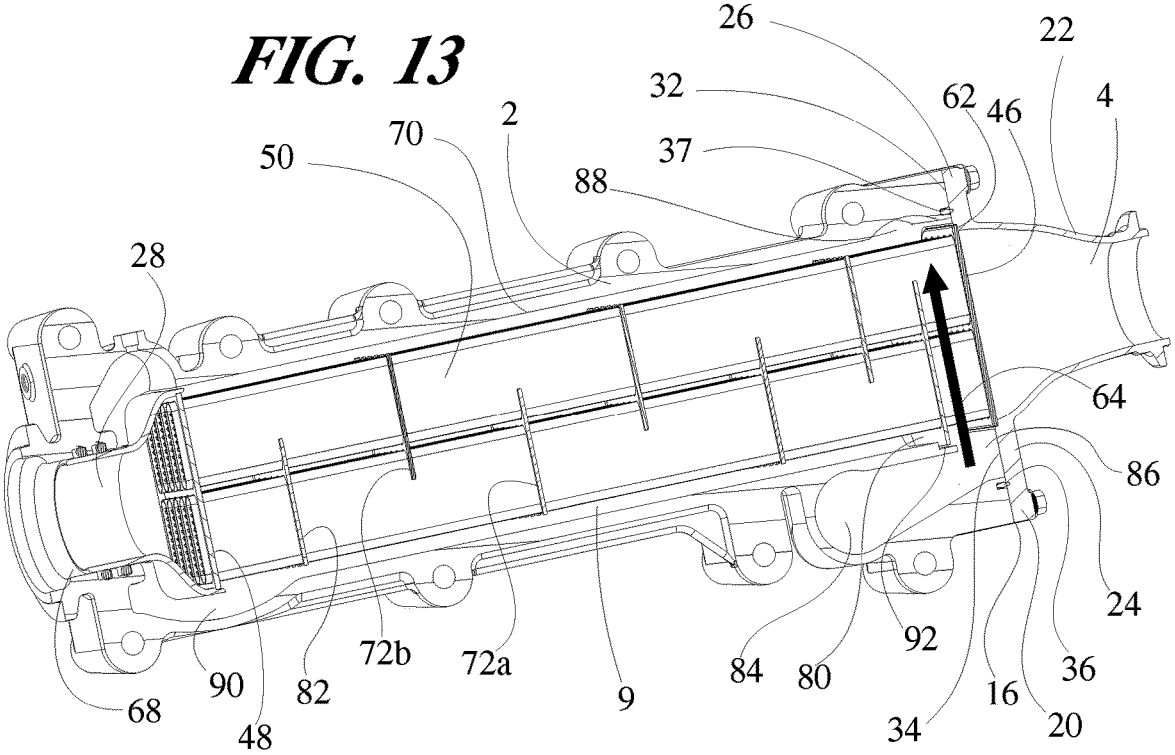

HEAT EXCHANGER

CROSS-REFERENCE TO RELATED APPLICATIONS

This application claims priority to U.S. provisional patent application No. 62/800,189, filed on Feb. 1, 2019, the entire contents of which are hereby incorporated by reference in their entirety.

BACKGROUND

The invention relates to heat exchangers for transferring heat between a gas and a liquid, and, especially to exhaust gas heat exchangers or exhaust gas recirculation coolers that might be found exchanging heat between exhaust gas of a vehicle and coolant of the vehicle. Further, this invention concerns the joining and the sealing together of different components and assemblies of an exhaust gas heat exchanger, and the resulting flow channels for coolant and gas. While exhaust gas coolers are known, the current state of the art does not include several features of the current invention, like, among other things, the joining and sealing together of multiple components to align such components.

SUMMARY

According to an embodiment of the invention, a heat exchanger is configured to direct a flow of coolant around a separate flow of exhaust gas, where the coolant takes heat from the exhaust gas through heat exchange. To accomplish this, a tube assembly directs the exhaust gas through the heat exchanger, and a housing directs the coolant through the heat exchanger, where the tube assembly is located within the housing. The heat exchange action between the gas and the coolant happens at surfaces of the tube assembly—the gas being on one side of the surfaces and the coolant being on the other side of the surfaces. The gas and the coolant are kept separate within the heat exchanger, each of the gas and the coolant having a distinct flow pattern through the heat exchanger.

An embodiment of the current invention contains the exhaust gas and the coolant separately within the heat exchanger via diffuser assemblies arranged at opposite ends of the tube assembly and housing. The housing extends along a longitudinal axis from a first end to a second end, both ends having openings being sealed by the diffuser assemblies, and the tube assembly extending through one of the openings. The housing also includes coolant inlet and outlet ports that fluidly communicate with an interior of the housing. For this embodiment, the coolant inlet port is located on an opposite longitudinal end of the housing relative to the coolant outlet port. The diffuser assemblies may include a first, fixed diffuser that is fixedly joined and fluidly sealed to the first end of the housing and a second non-fixed diffuser that is slidably retained and fluidly sealed within the second end of the housing. The tube assembly is further sealed to the diffusers at opposite ends of the tube assembly by header plates joined to the diffusers. Therefore, the gas is sealed within the tube assembly by the diffuser assemblies, the coolant is also sealed within the housing and to the outside of the tube assembly by the diffuser assemblies.

Due to the diffuser assemblies being each fluidly sealed to the tube assembly and the housing, the exhaust gas can enter the heat exchanger by one of the diffusers, flow through the tube assembly, and then exit the heat exchanger via the other diffuser, being fully contained inside the assembly of the diffuser assemblies and the tube assembly while passing through the heat exchanger. The coolant, on the other hand, is fully contained within the housing and outside of the tube assembly, as the coolant enters the housing by an inlet port, flows through and around the tube assembly, and exits the housing via an outlet port.

Per an embodiment, the diffusers are joined and fluidly sealed to the tube assembly by header plates. A header plate is located at each end of the tube assembly. The header plates each have holes closely framed by a perimeter. Each hole of the header plates contains a tube of the tube assembly, being joined and sealed to the tube near one of the ends of the tube. In an embodiment, the header plates each have a planar geometry, with flat, front and back surfaces. The tube assembly includes a plurality of tubes, and in an embodiment, the tubes have an elongated cross-sectional geometry being longer along a major axis and shorter along a minor axis. Also, in this embodiment, the tubes are oriented in the same direction and aligned in rows. It is conceivable that the tubes have different shapes and orientations in some embodiments, for example, having circular cross-sections or being offset from each other. In an embodiment, a solid rim frames the holes, being located between the perimeter of the header plates and the holes and having a rim width which is the same or less in distance than a tube width along a minor axis of one of the tubes. The header plates are joined and fluidly sealed to the diffusers by a metallurgical connection, like brazing or welding, each header plate being joined to one of the diffusers at an end of the diffuser facing the tube assembly or facing the other diffuser.

The diffusers of an embodiment are each sealed to housing in different ways to help mitigates the effects of thermal expansion on the heat exchanger. Thermal expansion often happens to different components differently, components expanding and contracting at different rates. In an embodiment, one of the diffusers is fixed to the housing via fasteners, and the other of the diffusers is not fixed to the housing, but floats within a seal in the opening at the second end of the housing. In this way, the tube assembly can slide within the housing should the tube assembly grow or contract more or less than the housing.

The fixed diffuser described above is particularly mated to the first end of the housing in an embodiment to ensure a tight and sealed joint between the housing and the fixed diffuser and to minimize the components and materials within the joint, which also increases the reliability of the joint and reduces the cost of the joint. The gasket and seal material is minimized in this joint configuration, and the header plate is eliminated from the joint, which further simplifies the joint, requiring less precise surface finishes on the joint surfaces of the header plate and the diffuser. Further, this joint configuration at the fixed diffuser provides for increased coolant exposure to a cap surface of the fixed diffuser and to the back surface of the header plate at the fixed diffused. This coolant exposure is especially helpful at the fixed diffuser, which is located at an exhaust gas inlet end of the heat exchanger—the end with the hottest temperatures.

To accomplish this particular joint in an embodiment, the heat exchanger includes flat machined surfaces on both the housing and the fixed diffuser that will abut tightly as the fixed diffuser is fastened to the housing by fasteners, such as bolts. In an embodiment, both the housing and the fixed diffuser are formed by a casting process, and the flat surfaces are machined into each of the housing and the fixed diffuser to achieve geometrically similar mating surfaces for tightly abutting these surfaces of these components. The flat surface of the housing surrounds a first opening of the housing at the first end. The flat surface of the fixed diffuser is located on a flange of the fixed diffuser, where the flange extends outwardly from a fixed diffuser wall. In an embodiment, both the flat surface of the housing and the flange of the fixed diffuser have holes to accept fasteners for attaching the fixed diffuser to the housing. Also, in an embodiment, the first end of the housing includes a gasket channel to retain a compressible gasket. In another embodiment, the fixed diffuser or both the housing and the fixed diffuser may have a channel to receive such a gasket. The gasket helps to ensure that the joint between the flat surface of the housing and the flat surface of the fixed diffuser is fluidly sealed.

This joint between the flat surface of the housing and the flat surface of the fixed diffuser aligns at least partially with the first header plate and with the gasket in a first transverse plane, perpendicular to the longitudinal axis, in an embodiment. As discussed above, the gasket is sandwiched between the flat surface of the housing and the flat surface of the fixed diffuser. The flat surface of the fixed diffuser extends from a perimeter of the fixed diffuser to the diffuser wall and includes a cap surface portion that extends toward the center of the housing beyond the flat surface of the housing to at least partially cover or cap the first opening. In an embodiment, the cap surface portion extends along the first transverse plane. In other embodiments, the cap surface portion may be in a plane different from the first transverse plane. In an embodiment, the fixed diffuser further includes a shoulder at an outlet end of the diffuser wall. The shoulder is offset from the cap surface portion of the fixed diffuser. The rim of the first header plate is seated on the shoulder and at least partially received into the fixed diffuser, and the rim is welded or brazed to the fixed diffuser, in an embodiment. This arrangement provides a coolant cross-channel along the first transverse plane such that coolant is exposed to the cap surface portion of the fixed diffuser and the back surface of the first header plate. In an embodiment, the perimeter of the header plate fits within the first opening of the housing surrounded by the flat surface of the housing and avoids extending to the flat surface.

In an embodiment, the housing has one type of opening at one end and another type of opening at the other, opposite end for, among other reasons, helping to mitigate the effects of thermal expansion and contraction on the components of the heat exchanger, for example, by allowing the tube assembly to expand and contract within the housing without being constrained by the housing, as it is free to slide at the second end of the housing. In an embodiment discussed above, the first opening at the first end is sealed by the fixed diffuser, which caps the first opening and is fixedly attached to the first end by fasteners. A second opening at the second end can be defined by an inner diameter. At least one o-ring seal can be located within the inner diameter at the second end. The o-ring seal or seals can then be disposed around the second diffuser to fluidly seal the second diffuser to the housing and to provide freedom of movement of the tube assembly.

A flow of coolant within the heat exchanger of an embodiment is directed by an interior surface of the housing, by the construction of the tube assembly, and by the arrangement of the first and second diffusers. The housing provides a coolant channel that at least partially extends in a longitudinal direction parallel to the longitudinal axis from the first end to the second end of the housing. Coolant enters the housing at the inlet port and exits the housing at the outlet port. In an embodiment, the inlet port is arranged near the first end and the outlet port is arranged near the second end. The tubes of the tube assembly are oriented in the same direction with the major axis of each tube aligned parallel to a second axis perpendicular to the longitudinal axis and each tube aligned in rows to provide a plurality of coolant cross-flow channels through the tube assembly, which are perpendicular to the longitudinal axis. One of these coolant cross-flow channels, for an embodiment above, extends along the first header and the cap surface of the fixed diffuser. The cross-flow channels are delimited by a plurality of baffles extending parallel to the second axis into the tube assembly beyond at least one row and into the next row according to an embodiment. The plurality of baffles direct the flow of coolant into a generally serpentine pattern through the housing. To achieve this pattern, a first set of baffles extends in a first baffle direction parallel to the second axis into the tube assembly, and a second set of baffles extends in second baffle direction, opposite of the first baffle direction into the tube assembly. Both the first set and the second set extend parallel to a third axis perpendicular to both the longitudinal axis and the second axis from a first interior side of the housing to an opposite second interior side of the housing to at least partially obstruct the flow of coolant in the longitudinal direction. The baffles of the first set are arranged to alternate in the longitudinal direction with baffles of the second set to force the flow of coolant to switch back and forth in a pattern alternating between the first baffle direction and the second baffle direction as the coolant generally travels in the longitudinal direction.

The flow of coolant is further forced to cross over or adjacent to the diffusers due to the baffle arrangement in at least one embodiment, and more specifically, due to the arrangement of the plurality of baffles in parallel to the second axis. The plurality of baffles includes a first baffle and a last baffle, each of which extends into the tube assembly from a side of the tube assembly that is opposite of the side of the housing inlet and the housing outlet, respectively, in at least one embodiment. The first baffle further differs in geometry from the other baffles of the plurality of baffles, as it extends between the interior surface of the housing and the tube assembly to obstruct the flow of coolant in the longitudinal direction. In this way, the first baffle also extends radially in the second baffle direction farther than the first header does. Thus, the flow of coolant must cross along the first/fixed diffuser before it can travel further in the longitudinal direction. The flow of coolant must also cross over the second diffuser before it can exit the housing through the housing outlet in at least one embodiment due to the arrangement of the last baffle. Further, while the housing outlet is located adjacent to the second opening to maximize the coolant channel and the flow of coolant within the housing, the housing inlet is located offset from the first opening for the same reason. The offset location of the housing inlet provides for additional exposure of the first/fixed diffuser to the coolant, as the coolant flows from the housing inlet through a coolant inlet channel that is a least partially defined by the cap surface of the first diffuser. Also, the interior surface of the housing includes an interior opening that is also defined, at least partially, by the cap surface. The interior opening is located between the cap surface and the first baffle such that the coolant enters the coolant channel via the interior opening. To achieve this coolant flow pattern, the first header is located within the first opening skewing toward one side of the opening in the first baffle direction, the perimeter of the first header being smaller in size than the first opening.

Further to enhance to flow of coolant in at least one embodiment, the interior surface of the housing includes a first recess at a first end of the housing and a second recess at a second end of the housing. The first recess is located opposite of the housing inlet, and the second recess is located opposite of the housing outlet. The first recess is at least partially located within a plane defined by the first baffle. The second recess is at least partially located within a plane defined by the second header plate.

BRIEF DESCRIPTION OF THE DRAWINGS

FIG. 1 is a front view of a heat exchanger of an embodiment of the invention.

FIG. 2 is a bottom view of the heat exchanger of FIG. 1.

FIG. 3 is a side view of the heat exchanger of FIG. 1.

FIG. 12 is a sectional front view of the heat exchanger of FIG. 1.

FIG. 13 is a sectional front perspective view of the heat exchanger of FIG. 1.

DETAILED DESCRIPTION

Figure 4:
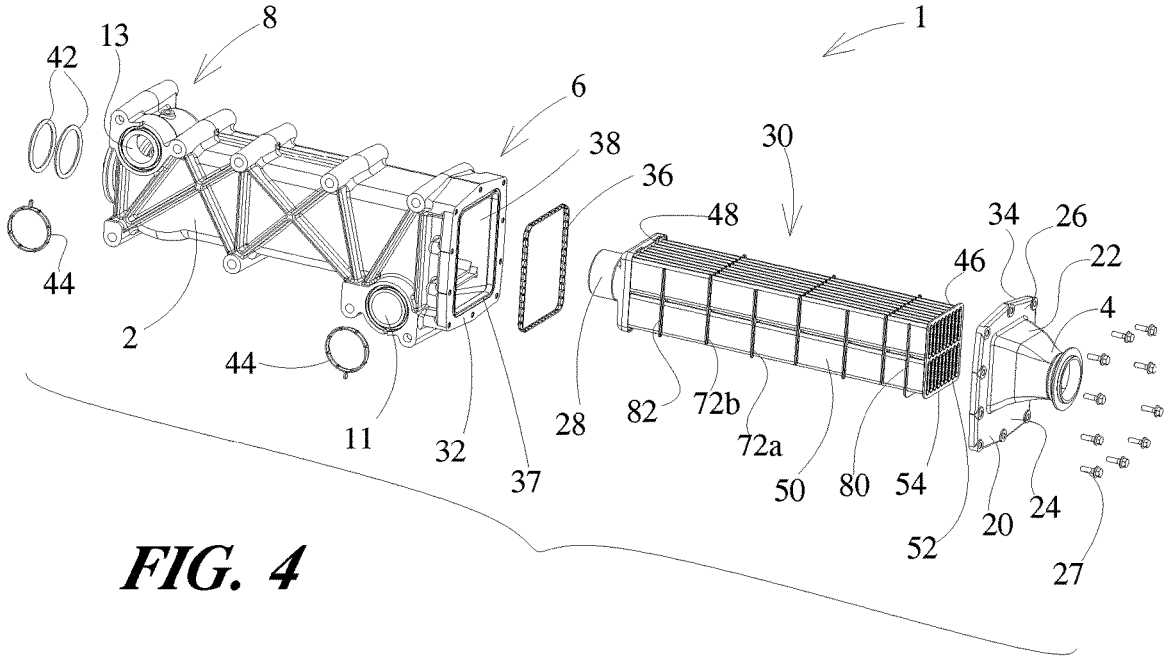
FIG. 4 is an exploded front perspective view of the heat exchanger of FIG. 1.

Before any embodiments of the invention are explained in detail, it is to be understood that the invention is not limited in its application to the details of construction and the arrangement of components set forth in the following description or illustrated in the accompanying drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "mounted," "connected," "supported," and "coupled" and variations thereof are used broadly and encompass both direct and indirect mountings, connections, supports, and couplings. Further, "connected" and "coupled" are not restricted to physical or mechanical connections or couplings.

A heat exchanger 1 embodying the present invention is shown in FIGS. 1-15. The preferred embodiment is an exhaust gas heat exchanger that cools exhaust gas with a coolant. The coolant flows through a housing 2 and around a flow of exhaust gas.

FIGS. 1-3 depict a preferred embodiment of the current invention, showing the heat exchanger 1 with the housing 2 fixedly attached directly to a first diffuser 4 at a first end 6 of the housing 2. FIGS. 1 and 2 further show that the housing 2 extends from the first end 6 to a second end 8 along a longitudinal axis 10. In the preferred embodiment, the housing 2 includes an inlet port 11 near the first end 6 and an outlet port 13 near the second end 8 for a coolant in a coolant channel 9 (best shown in FIGS. 12-13) to flow from the first end 6 to the second end 8. In other embodiments, the arrangement of the inlet port 11 and the outlet port 13 is reversed with respect to the housing 2. FIG. 2 further shows that the housing 2 is joined to the first diffuser 4 at a first joint 16 along a first transverse plane 18 (shown in FIG. 2) perpendicular to the longitudinal axis 10. The first diffuser 4 of the preferred embodiment has a flange 20 that extends outwardly from a first diffuser wall 22, as shown in FIG. 3. The flange 20 includes a long side 24 and a short side 26, as also shown in FIG. 3. In the preferred embodiment, the first diffuser 4 is fastened to the housing 2 with a plurality of bolt-type fasteners 27 extending through the flange 20.

Figure 14:
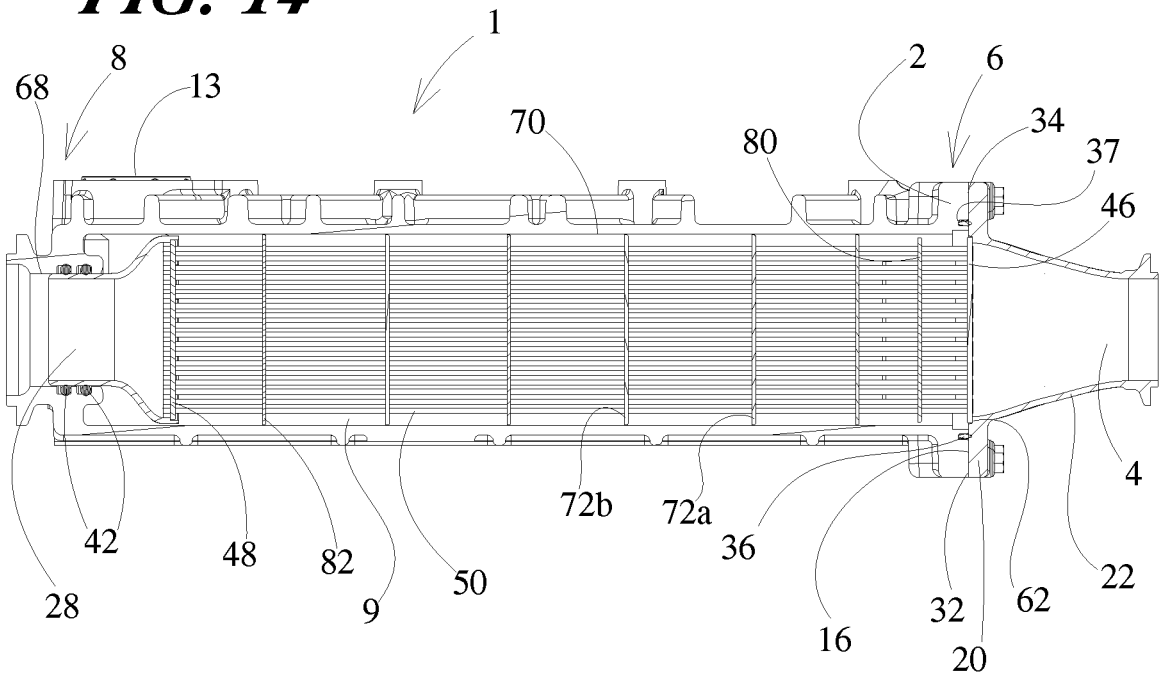
FIG. 14 is a sectional bottom view of the heat exchanger of FIG. 1.
Figure 15:
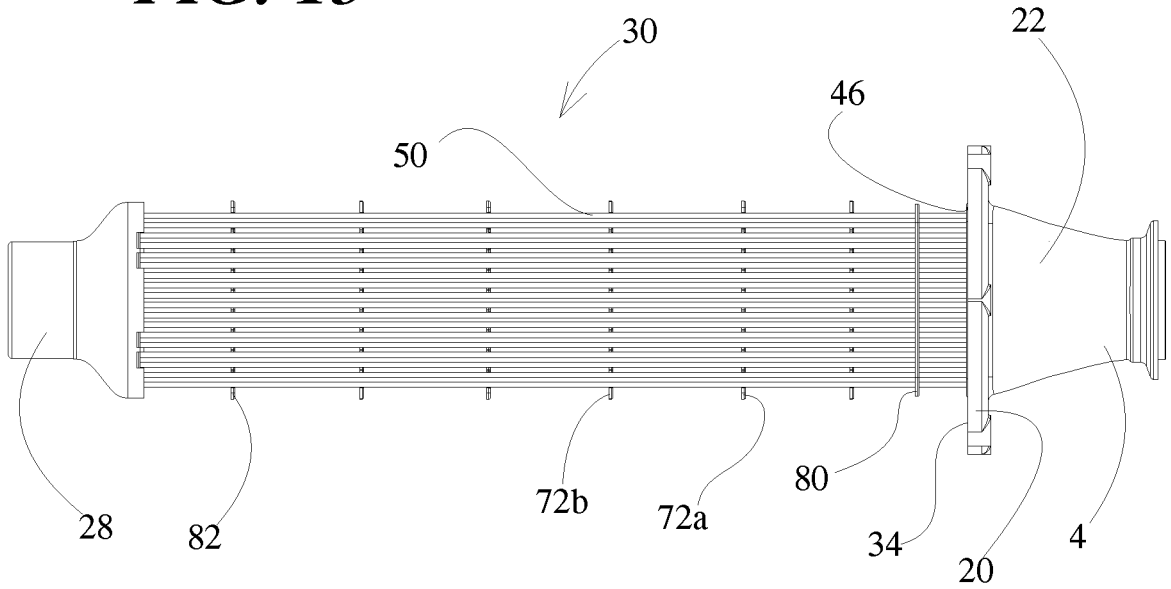
FIG. 15 is a bottom view of the sub-assembly of the heat exchanger of FIG. 1.

FIG. 3 also indicates transverse sections through the heat exchanger and displayed in FIGS. 12-14. Line 12 indicates the vertical section of FIG. 12, and line 14 indicates the horizontal section of FIG. 14.

Figure 5:
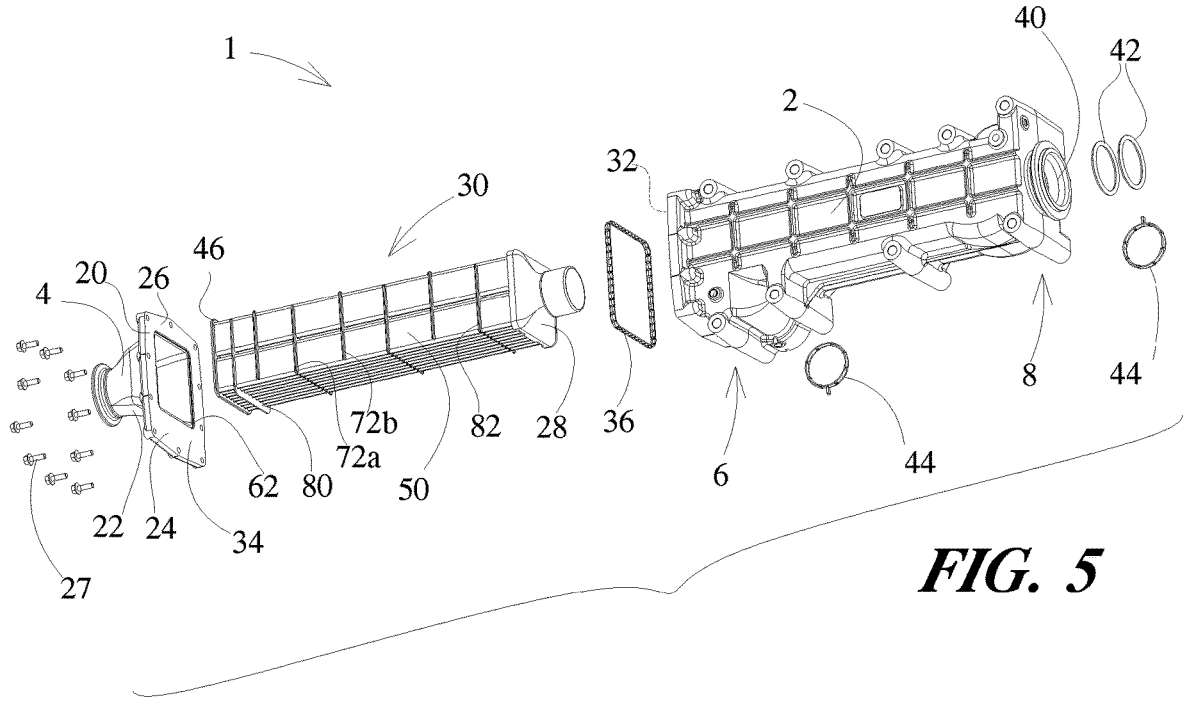
FIG. 5 is an exploded rear perspective view of the heat exchanger of FIG. 1.

FIGS. 4 and 5 are exploded front and rears views, respectively, of the preferred embodiment and depict a tube assembly 30 that is insertable within the housing 2. The tube assembly 30 has the first diffuser 4 mounted to one end of the tube assembly 30 and a second diffuser 28 mounted to the other end of the tube assembly 30. FIGS. 4-5 further show the construction of the first joint 16 where mating surfaces of a first surface 32 of the housing 2 and a cap surface 34 of the flange 20 of the first diffuser 4 each have a planar geometry that engage each other. According to FIGS. 4 and 5, the preferred embodiment also includes a gasket 36 arranged between the first surface 32 and the cap surface 34. In the preferred embodiment, the gasket 36 is retained within a gasket channel 37 in the first surface 32. In other embodiments, the gasket channel 37 is only in the cap surface 34 or both in the first surface 32 and the cap surface 34. The first surface 32 surrounds a first opening 38 of the first end 6 of the housing 2. The second end 8 of the housing includes a second opening 40. At least one o-ring type seal 42 is arranged within the second opening 40. Further, port seals 44 are shown at the inlet port 11 and the outlet port 13. As discussed above, the first diffuser 4 in the preferred embodiment is fixedly attached to the housing 2. The second diffuser 28 of the preferred embodiment, however, is slidably received within at least one o-ring 42 of the second opening 40.

In the preferred embodiment, the first diffuser 4 and the second diffuser 28 are joined and fluidly sealed to the tube assembly 30 by a first header plate 46 and a second header plate 48, respectively. The header plates 46, 48 are located at each end of the tube assembly 30 and fluidly sealed to tubes 50 of the tube assembly, each tube 50 of the tube assembly 30 being sealed to a hole (not numbered) in both of the header plates 46, 48 near the ends of the tubes 50. In the preferred embodiment, the header plates 46, 48 each have a planar geometry, with flat, front and back surfaces. In preferred embodiment, each of the tubes 50 has an elongated cross-sectional geometry being longer along a major axis and shorter along a minor axis. Also, the tubes 50 are oriented in the same direction and aligned in rows. It is conceivable that the tubes have different shapes and orientations in other embodiments, for example, having circular cross-sections or being offset from each other. The first header 46 further has a perimeter 52, and between the holes and the perimeter 52 of the header plates is a solid rim 54 framing the holes. In this embodiment, the rim 54 has a rim width 56 from the holes to the perimeter 52, which is the same or less in distance than a tube width (not numbered) along the minor axis of one of the tubes. The headers plates 46, 48 are joined and fluidly sealed to the diffusers 4, 28 by a metallurgical connection, like brazing or welding, each header plate 46, 48 being joined to one of the diffusers 4, 28 at an end of the diffuser facing the tube assembly 30 or facing the other diffuser.

Figure 6:
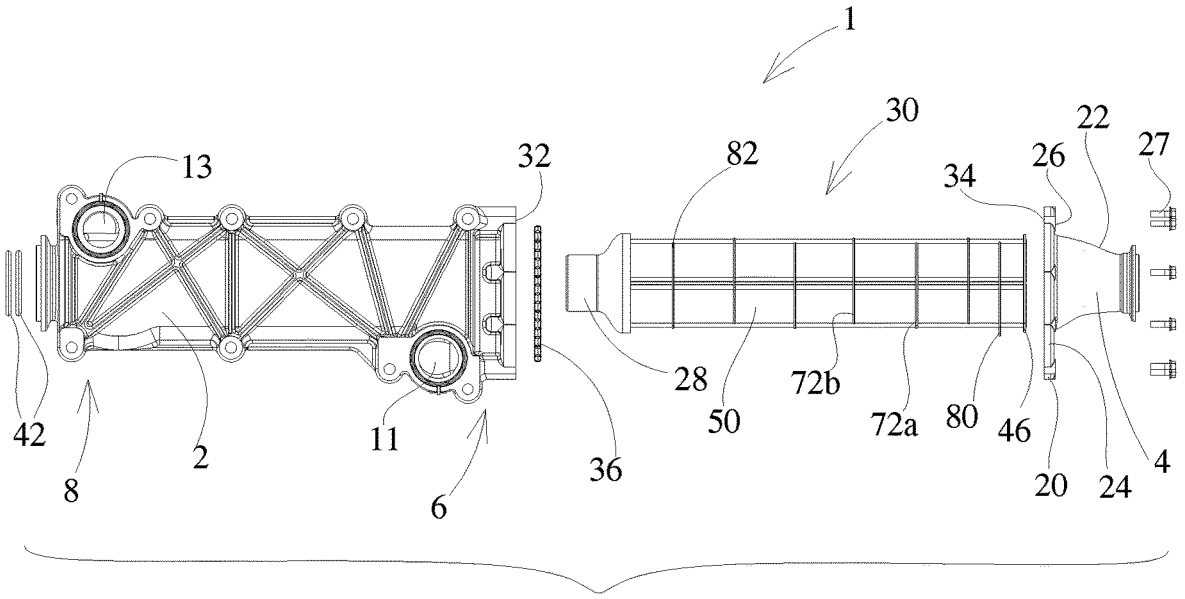
FIG. 6 is an exploded front view of the heat exchanger of FIG. 1.
Figure 7:
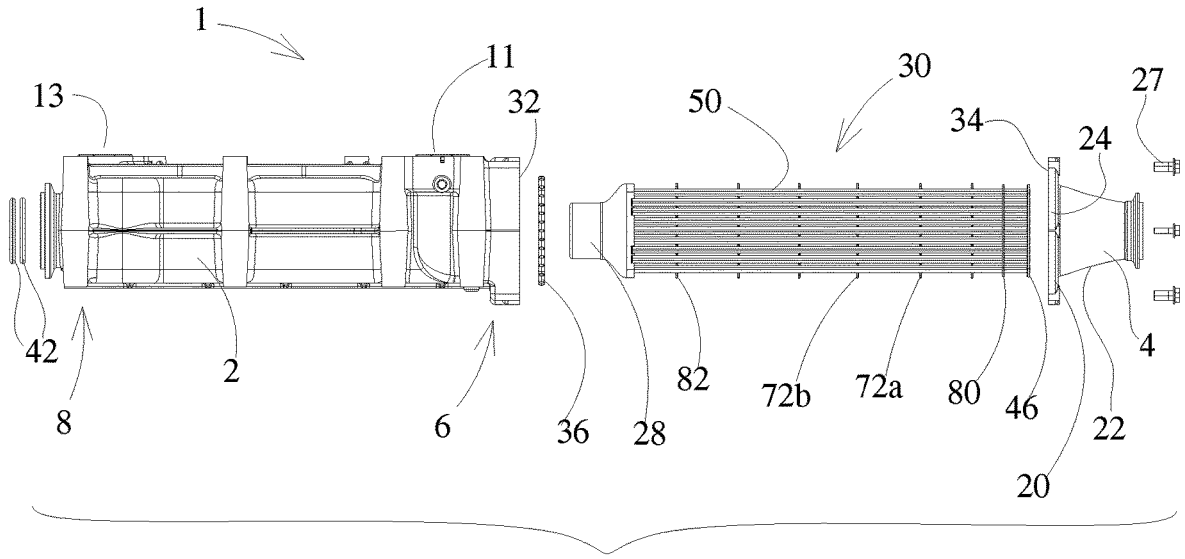
FIG. 7 is an exploded bottom view of the heat exchanger of FIG. 1.
Figure 8:
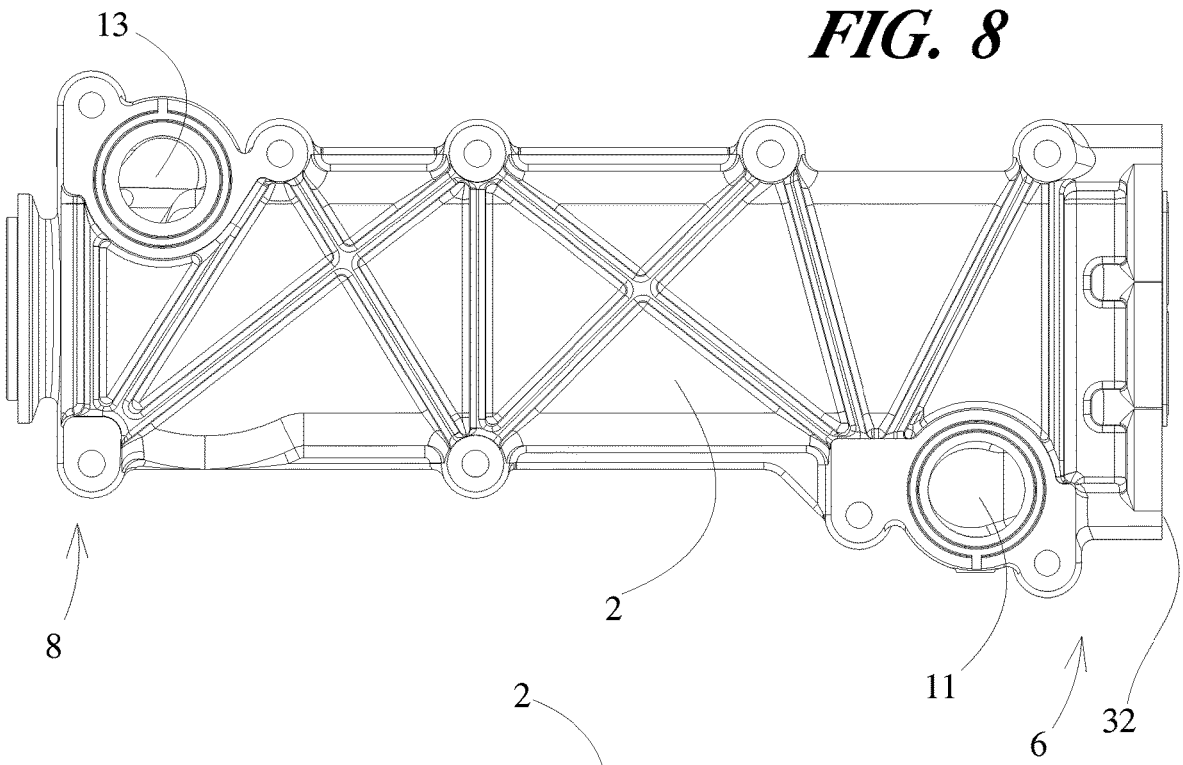
FIG. 8 is a partial front view of the heat exchanger of FIG. 1.
Figure 9:
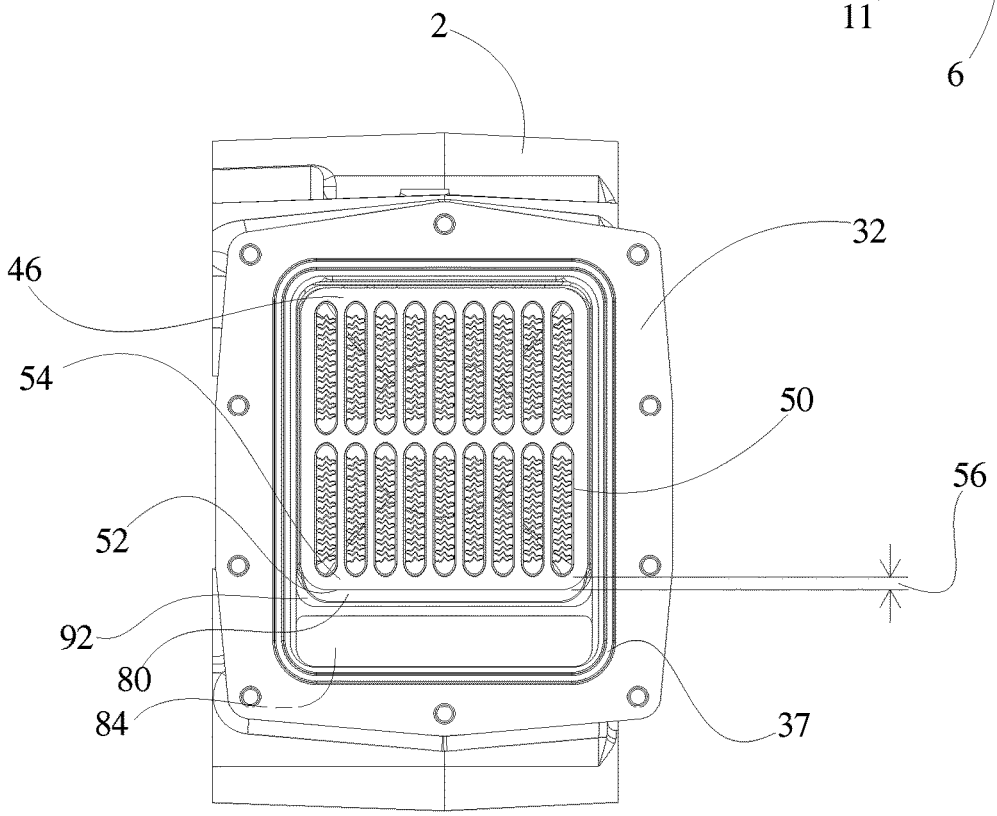
FIG. 9 is a partial side view of the heat exchanger of FIG. 1.
Figure 10:
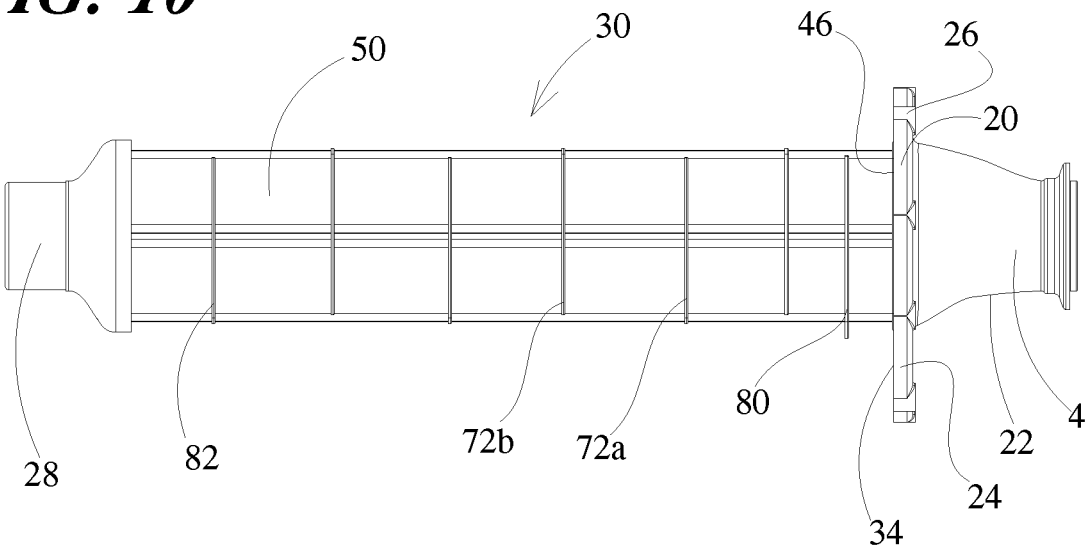
FIG. 10 is a front view of a sub-assembly of the heat exchanger of FIG. 1.
Figure 11:
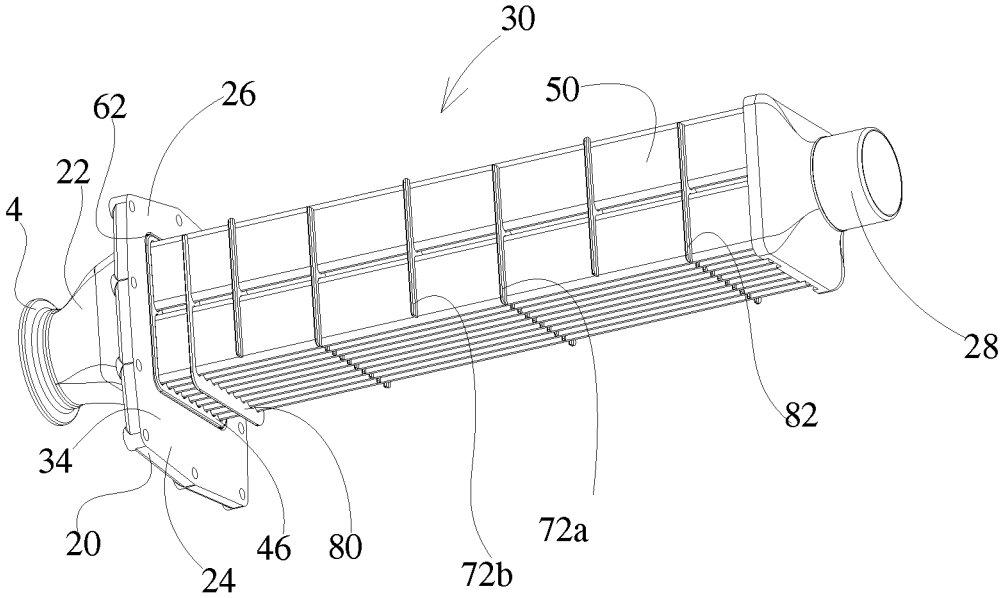
FIG. 11 is a rear perspective view of the sub-assembly of the heat exchanger of FIG. 1.

As shown in FIGS. 6 and 7, the heat exchanger 1 of the preferred embodiment flat machined surfaces 32, 34 on both the housing 2 and the first diffuser 4 that will abut tightly as the first diffuser 4 is fastened to the housing 2 by the fasteners 27, such as bolts. Further, in the preferred embodiment, both the housing 2 and the first diffuser 4 are formed by a casting process, and the flat surfaces 32, 34 are machined into the casting of the housing 2 and the first diffuser 4 to achieve geometrically similar mating surfaces for tightly abutting these surfaces of these components. The flat surface 32 of the housing 2 surrounds a first opening 38 of the housing 2 at the first end 6. The flat surface 34 of the first diffuser 4 is located on a flange 20 of the first diffuser 4, where the flange 20 extends outward radially from the first diffuser wall 22 to a perimeter 58 of the first diffuser 4. In this embodiment, both the flat surface 32 of the housing 2 and the flange 20 of the first diffuser 4 have holes (not numbered) to accept fasteners 27 for attaching the first diffuser 4 to the housing 2. Further, the first end 6 of the housing 2 includes the gasket channel 37 to retain the compressible gasket 36, in this embodiment. In another embodiment, the first diffuser 4 or both the housing 2 and the first diffuser 4 may have a channel to receive such a gasket. The gasket 37 helps to ensure that the joint 16 between the flat surface 32 of the housing 2 and the flat surface 34 of the first diffuser 4 fluidly seals the coolant within the housing 2.

The joint 16 between the flat surface 32 of the housing 2 and the flat surface 34 of the first diffuser 4 aligns at least partially with the first header plate 46 and with the gasket 37 in the first transverse plane 18, perpendicular to the longitudinal axis 10. As discussed above, the gasket 37 is sandwiched between the flat surface 32 of the housing 2 and the flat surface 34 of the first diffuser 4. The flat surface 34 of the first diffuser 4 includes a cap surface portion 60 that covers at least a portion of the coolant channel 9, extending over the first opening 38 of the housing 2 to at least partially cover or cap the first opening. In this embodiment, the cap surface portion 60 extends along the first transverse plane 18. In other embodiments, the cap surface portion 60 may be in a plane different from the first transverse plane 18. The first diffuser 4 further includes a shoulder 62 at an outlet end (not numbered) of the diffuser wall 22. The shoulder 62 is offset from the cap surface portion 60 of the first diffuser 4. The rim 54 of the first header plate 46 is seated on the shoulder 62 and at least partially received into the first diffuser 4, and the first header plate 46 is welded or brazed to the first diffuser 4 at the perimeter 52 or the rim 54 of the first header plate 46. This arrangement provides a first coolant cross-channel 64 along the first transverse plane 18 such that coolant is exposed to the cap surface portion 60 of the first diffuser 4 and a back surface of the first header plate 46. Further, as the header plate 46 fits within the first diffuser 4 at the shoulder 62, the perimeter 52 of the header plate therefore fits within the opening 38 of the housing 2 surrounded by the flat surface 32 and avoids extending to the flat surface 32.

In this embodiment, the housing 2 has one type of opening at one end and another type of opening at the other, opposite end for, among other reasons, helping to mitigate the effects of thermal expansion and contraction on the components of the heat exchange. That is, the tube assembly is free to slide at the second end 8 of the housing 2, and is therefore able to expand and contract within the housing 2. As discussed above, the first opening 38 at the first end 6 is sealed by the first diffuser 4, which caps the first opening 38 and is fixedly attached to the first end 6 by fasteners 27. A second opening 40 at the second end 8, however, is defined by an inner diameter 68. At least one o-ring seal 42 is located within the inner diameter 68 at the second end 8. The at least one o-ring seal 42 is disposed around the second diffuser 28 to fluidly to provide freedom of movement of the tube assembly 30 as discussed above.

A flow of coolant within the heat exchanger 1 of this embodiment is directed by an interior surface 70 of the housing, by the construction of the tube assembly 30, and by the arrangement of the first 4 and second diffusers 28. The housing 2 defines the coolant channel 9 that at least partially extends in a longitudinal direction parallel to the longitudinal axis 10 from the first end 6 to the second end 8 of the housing 2. Coolant enters the housing 2 at the inlet port 11 and exits the housing 2 at the outlet port 13. In this embodiment, the inlet port 11 is arranged near the first end 6 and the outlet port 13 is arranged near the second end 8. The tubes 50 of the tube assembly 30 are each oriented in the same direction with the major axis of each tube 50 aligned parallel to a second axis perpendicular to the longitudinal axis 10 and with each tube 50 aligned in rows to provide a plurality of coolant cross-flow channels through the tube assembly 30, which are perpendicular to the longitudinal axis 10. A first coolant cross-flow channel 64 of the coolant cross-flow channels, as discussed above, extends along the first header 46 and the cap surface portion 60 of the first diffuser 4, as shown in FIG. 13. The cross-flow channels are delimited by baffles 72 extending parallel to the second axis into the tube assembly 30 beyond at least one row and into the next row according to this embodiment. The baffles 72 direct a flow of coolant 74 into a generally serpentine pattern through the housing as shown in FIG. 12. To achieve this pattern, a first set of baffles 72*a* extends in a first baffle direction parallel to the second axis into the tube assembly, and a second set of baffles 72*b* extends in second baffle direction, opposite of the first baffle direction into the tube assembly 30. Both the first set 72*a* and the second set 72*b* extend parallel to a third axis perpendicular to both the longitudinal axis 10 and the second axis from a first interior side of the housing to an opposite second interior side of the housing to at least partially obstruct the flow of coolant 74 in the longitudinal direction. The baffles 72*a* of the first set are arranged to alternate in the longitudinal direction with baffles 72*b* of the second set to force the flow of coolant 74 to switch back and forth in a pattern alternating between a first baffle direction and a second baffle direction as the coolant generally travels in the longitudinal direction, as shown in FIG. 12.

The flow of coolant 74 is further forced to cross over or to cross adjacent to the diffusers 4, 28 due to the baffle arrangement of this embodiment. A first baffle 80 and a last baffle 82 each extend into the tube assembly 30 from a side of the tube assembly 30 that is opposite of the side of the housing inlet port 11 and the housing outlet 13, respectively.

The first baffle 80 further differs in geometry from the baffles 72, as it extends between the interior surface 70 of the housing and the tube assembly 30 to obstruct the flow of coolant 74 in the longitudinal direction. A first baffle slot 92 in the interior surface 70 of the housing 2 accommodates the extra length of the first baffle 80. In this way, the first baffle 80 extends radially in the second baffle direction farther than the first header 46 does. Thus, the flow of coolant 74 must cross along the cap surface portion 60 of first diffuser 4 before it can travel further in the longitudinal direction, and the flow of coolant 74 must cross over the second diffuser 28 before it can exit the housing 2 through the housing outlet port 13. Further, the housing outlet port 13 is located adjacent to the second opening 40 to maximize the coolant channel and the flow of coolant 74 within the housing 2, and the housing inlet port 11 is located offset from the first opening 38 for the same reason—to maximize coolant flow. The offset location of the housing inlet port 11 provides for additional exposure of the first diffuser 4 to the coolant, as the coolant flows from the housing inlet port 11 through coolant inlet channel 84 that is a least partially defined by the cap surface portion 60 of the first diffuser 4. Also, the interior surface 70 of the housing 2 includes an interior opening 86 that is also defined at least partially by the cap surface portion 60. The interior opening 86 is located between the cap surface portion 60 and the first baffle 80 such that the coolant enters the coolant channel via the interior opening 86. To achieve this coolant flow pattern, the first header 46 is located within the first opening 38 skewing toward one side of the opening 38 in the first baffle direction, the perimeter 52 of the first header 46 being smaller in size than the first opening 38, as discussed above.

Further to enhance to flow of coolant 74, the interior surface 70 of the housing 2 includes a first recess 88 at the first end 6 of the housing 2 and a second recess 90 at a second end 8 of the housing 2. The first recess 88 is located opposite of the housing inlet port 11, and the second recess 90 is located opposite of the housing outlet port 13. The first recess 88 is at least partially located within a plane defined by the first baffle 80. The second recess 90 is at least partially located within a plane defined by the second header plate 48.

Various alternatives to the certain features and elements of the present invention are described with reference to specific embodiments of the present invention. With the exception of features, elements, and manners of operation that are mutually exclusive of or are inconsistent with each embodiment described above, it should be noted that the alternative features, elements, and manners of operation described with reference to one particular embodiment are applicable to the other embodiments.

The embodiments described above and illustrated in the figures are presented by way of example only and are not intended as a limitation upon the concepts and principles of the present invention. As such, it will be appreciated by one having ordinary skill in the art that various changes in the elements and their configuration and arrangement are possible without departing from the spirit and scope of the present invention.

What is claimed is:

1. An exhaust gas heat exchanger, comprising:

a housing including an inlet port, an outlet port, an interior facing surface at least partially defining a coolant channel, a first opening surrounded by an exterior facing surface, and a second opening defined by a first inner diameter;

a tube assembly at least partially defining a plurality of exhaust gas flow channels and defining a plurality of coolant cross channels, the tube assembly including a plurality of tubes;

a first header plate having a first header plate perimeter;

a first diffuser including a cap surface, a diffuser wall, a first diffuser perimeter, and a diffuser flange extending from the diffuser wall to the first diffuser perimeter, the diffuser flange having a plurality of sections, the cap surface enclosing the coolant channel at the first opening; and a first internal opening formed within the interior facing surface of the housing and fluidly connected to the inlet port by a coolant inlet channel, wherein the tube assembly is disposed within the housing, wherein the first header plate is at least partially located inside of the housing, and the first header plate perimeter surrounds the tube assembly, wherein the first diffuser is fixedly attached to the housing at a first joint located between the cap surface and the exterior facing surface, the cap surface abutting the exterior facing surface, wherein the first header plate is welded or brazed to the cap surface at a second joint located along the first header plate perimeter, wherein the first joint and the second joint are at least partially located within a first plane transverse to a longitudinal axis of the heat exchanger, wherein the coolant channel is at least partially disposed between the first joint and the second joint and at least partially disposed along the cap surface, wherein the plurality of sections includes a first section and a second section located on opposite sides of the first diffuser, wherein the first section is partially defined by a first length from the diffuser wall to the first diffuser perimeter, wherein the second section is partially defined by a second length from the diffuser wall to the first diffuser perimeter, wherein the first length is greater than the second length, wherein the first internal opening is at least partially defined by the first section, wherein the cap surface is located on the first diffuser flange, wherein each tube of the plurality of tubes is oriented to provide a first set of coolant cross channels parallel to a first axis and a second set of at least one coolant cross channel parallel to a second axis, wherein the first set of coolant cross channels is larger than the second set of coolant cross channels, wherein the first length is parallel to the first axis, wherein the second length is parallel to the first axis, and wherein the exhaust gas heat exchanger further comprises:

a plurality of baffles including a first set of baffles extending in a first direction parallel to the first axis at least partially into the first set of coolant cross channels and including a second set of baffles extending in a second direction opposite of the first direction at least partially into the first set of coolant cross channels;

a first side, a second side, a third side, and a fourth side of the interior facing surface of the housing;

a second internal opening of the housing fluidly connected to the outlet port and located in one of the first side and the third side of the housing;

a first set of gaps between the first set of baffles and the first side to partially define the coolant channel along the first side; and a second set of gaps between the second set of baffles and the second side to partially define the coolant channel along the second side, wherein each of the baffles of the first set of baffles and the second set of baffles extends parallel to the second axis from the second side to the fourth side to obstruct the coolant channel along the second side and the fourth side, wherein baffles of the first set of baffles alternate with baffles of the second set of baffles in a third direction parallel to the longitudinal axis, and wherein the first internal opening is located in the first side of the housing.

2. The exhaust gas heat exchanger of claim 1, comprising:

a first baffle of the plurality of baffles, wherein the first baffle extends from the tube assembly to the first wall, and wherein the first internal opening is disposed between the first baffle and the first section of the plurality of sections of the diffuser flange.

3. The exhaust gas heat exchanger of claim 2, wherein the first baffle at least partially extends beyond the first header plate perimeter in a radial direction from the longitudinal axis.

4. The exhaust gas heat exchanger of claim 1, comprising:

a first gasket contacting both the cap surface and the exterior facing surface and at least partially located within the first plane, wherein the first gasket surrounds the first header plate.

5. The exhaust gas heat exchanger of claim 1, wherein, relative to the longitudinal axis, a first baffle of the first set of baffles is located between the inlet port and the cap surface and a last baffle of the first set of baffles is located between the outlet port and the cap surface, and wherein the first baffle and the last baffle are on opposite longitudinal ends of the tube assembly.

6. An exhaust gas heat exchanger of claim 5, wherein the first baffle of the first set of baffles is located on the same transverse side of the housing as the inlet port and wherein the last baffle of the first set of baffles is located on the opposite transverse side of the housing as the outlet port such that a coolant flows in the coolant channel across the cap surface and across a second diffuser.

7. The exhaust gas heat exchanger of claim 1, comprising:

a second diffuser disposed at least partially within the second opening, wherein the second diffuser is fluidly sealed to the second opening by at least one o-ring arranged within the second opening and arranged around the second diffuser, and wherein the second diffuser is capable of sliding parallel to the longitudinal axis within the second opening.

8. The exhaust gas heat exchanger of claim 1, comprising:

a first recess of the interior facing surface of the housing, the first recess extending outwardly in a radial direction from the longitudinal axis, wherein the second diffuser is defined by a first end of the second diffuser disposed within the second opening and a second end of the second diffuser opposite of the first end of the second diffuser relative to the longitudinal axis, wherein arrangement between a second end of the second diffuser and the housing provides a larger gap between the second end of the second diffuser and the interior facing surface at the recess than between the second end of the second diffuser and the interior facing surface at a side of the housing of the outlet port.

9. The exhaust gas heat exchanger of claim 8, comprising:

a second recess of the interior facing surface of the housing, the second recess extending outwardly in the radial direction from the longitudinal axis, wherein the second recess is located on an opposite longitudinal end of the housing relative to the first recess, and wherein a first baffle of the first set of baffles is oriented parallel to and within a recess plane that extends transverse to the longitudinal axis and intersects the second recess.

10. A method of making an exhaust gas heat exchanger, comprising:

assembling a plurality of tubes into a tube assembly having a first end and a second end;

joining each of the plurality of tubes to one of a first plurality of holes within a first header at the first end;

joining each of the plurality of tubes to one of a second plurality of holes within a second header at the second end;

welding a perimeter of the first header to a first diffuser;

joining the second header to a second diffuser;

assembling a first gasket to a first housing surface of a housing, the first gasket surrounding a first opening of the housing;

assembling at least one second gasket to an inner diameter of a second opening of the housing;

inserting the tube assembly within the housing, disposing the second diffuser within the at least one second gasket, arranging the perimeter of the first header within the housing, arranging a first diffuser surface of the first diffuser against the first housing surface to at least partially define an interior opening of the housing, and sandwiching the first gasket between the first housing surface and the first diffuser surface;

fastening the first diffuser to the housing around the perimeter of the first header; and arranging a first baffle to be spaced from the first diffuser surface and a back surface of the first header, such that the interior opening is positioned between the first baffle and the first diffuser surface, wherein the first baffle faces the first diffuser surface and the back surface of the first header, wherein the first baffle defines a coolant cross channel to direct coolant across the first diffuser surface and across the back surface of the first header, wherein the first header, the first diffuser surface, and the first gasket are at least partially arranged within a first transverse plane oriented transversely to a longitudinal axis of the heat exchanger, and wherein the first diffuser includes a long side and a short side, the long side at least partially defining the interior opening of the housing.

11. The method of making the exhaust gas heat exchanger of claim 10, comprising:

arranging the first diffuser surface to at least partially define a coolant channel and arranging the perimeter of the first header within the coolant channel.

12. The method of making the exhaust gas heat exchanger of claim 10, comprising:

inserting the perimeter of the first header at least partially within the first diffuser to engage a front surface of the first header with a shoulder of the first diffuser, the shoulder being offset from the first diffuser surface.

13. The method of making the exhaust gas heat exchanger of claim 10, comprising:

arranging a plurality of baffles in alternating orientations on the plurality of tubes to direct coolant within the housing in a serpentine pattern from a coolant inlet of the housing to a coolant outlet of the housing and to direct coolant across the plurality of tubes along the back surface of the first header and along the first diffuser surface, wherein the first baffle is one of the plurality of baffles.

14. The method of making the exhaust gas heat exchanger of claim 10, forming a coolant channel within the housing;

forming a coolant inlet to the coolant channel in the housing;

forming a coolant inlet channel within an interior of the housing that extends from the coolant inlet;

forming the interior opening within the interior of the housing, the interior opening being disposed between the coolant inlet channel and the coolant channel; and orienting each of the plurality of tubes in the same direction to provide coolant cross channels within the tubes, wherein the coolant cross channel is one of the coolant cross channels, wherein at least some of the coolant cross channels are aligned with the interior opening, and wherein the interior opening directs coolant into the at least some of the coolant cross channels.

15. The method of making the exhaust gas heat exchanger of claim 13, arranging the first baffle within the plurality of tubes and on a same side of the housing as the coolant inlet, arranging the first baffle to extend further radially from the longitudinal axis than the first header, and wherein the first baffle obstructs coolant from flowing parallel to the longitudinal axis.

16. The method of making the exhaust gas heat exchanger of claim 13, forming a diffuser flange into the first diffuser, extending the diffuser flange radially from the longitudinal axis to form at least a portion of a coolant channel, and arranging the diffuser flange to face the first baffle, to form a side of the interior opening and to at least partially form a coolant inlet channel.

17. An exhaust gas heat exchanger, comprising:

a housing capable of containing coolant, the housing having inlet port, an inlet port channel, an outlet port, an open interior extending between a first open end and a second open end, and a first planar surface surrounding the first open end;

a first diffuser enclosing the first open end of the housing, the first diffuser including diffuser flange, a planar cap surface on the diffuser flange facing the housing, a first diffuser wall, a diffuser inlet, a diffuser outlet, and a diffuser shoulder extending around the diffuser outlet;

a first header plate;

a second diffuser enclosing the second open end of the housing;

a second header plate;

at least one tube capable of containing a gas; and a first baffle, wherein the at least one tube extends from the first header plate to the second header plate, wherein the first header plate contacts the diffuser shoulder and seals the at least one tube to the first diffuser, wherein the second header plate seals the at least one tube to the second diffuser, wherein the first diffuser wall extends from the diffuser inlet to the diffuser shoulder, wherein the diffuser shoulder is disposed between the cap surface and the diffuser outlet in a radial direction from a longitudinal axis of the heat exchanger, wherein the cap surface is located between the first surface of the housing and the diffuser shoulder relative to the longitudinal axis, wherein the diffuser flange includes a short side and a long side, wherein the long side at least partially defines the inlet port channel, wherein the first baffle is arranged across from the cap surface and across from a back surface of the first header plate, wherein the first baffle faces the cap surface and the back surface of the first header plate, and wherein the first baffle defines a coolant cross channel to direct coolant across the cap surface and across the back surface of the first header plate.

* * * * *